US011361777B2

(12) United States Patent
Hume et al.

(10) Patent No.: US 11,361,777 B2
(45) Date of Patent: Jun. 14, 2022

(54) SOUND PRIORITISATION SYSTEM AND METHOD

(71) Applicant: Sony Interactive Entertainment Inc., Tokyo (JP)

(72) Inventors: Oliver Hume, London (GB); Fabio Cappello, London (GB); Marina Villanueva-Barreiro, Acoruna (ES); Michael Lee Jones, London (GB)

(73) Assignee: Sony Interactive Entertainment Inc., Tokyo (JP)

( * ) Notice: Subject to any disclaimer, the term of this patent is extended or adjusted under 35 U.S.C. 154(b) by 0 days.

(21) Appl. No.: 16/985,310

(22) Filed: Aug. 5, 2020

(65) Prior Publication Data

US 2021/0050023 A1 Feb. 18, 2021

(30) Foreign Application Priority Data

Aug. 12, 2019 (GB) ..... 1911530

(51) Int. Cl.
*G10L 19/008* (2013.01)
*G10L 19/16* (2013.01)
(Continued)

(52) U.S. Cl.
CPC ..... *G10L 19/008* (2013.01); *G10L 19/167* (2013.01); *H04S 3/008* (2013.01)

(58) Field of Classification Search
CPC ..... G10L 19/008; G10L 19/00; G10L 19/167; G10L 19/16; G10L 25/51; G10L 25/50;
(Continued)

(56) References Cited

U.S. PATENT DOCUMENTS

2007/0270988 A1* 11/2007 Goldstein ..... H04R 5/04 700/94
2011/0317852 A1* 12/2011 Kawano ..... H04H 60/04 381/98

(Continued)

FOREIGN PATENT DOCUMENTS

WO 2014099285 A1 6/2014
WO 2016172111 A1 10/2016

OTHER PUBLICATIONS

Extended European Report for corresponding EP Application No. 20187359.3, 7 pages, dated Feb. 8, 2021.

(Continued)

*Primary Examiner* — Leshui Zhang
(74) *Attorney, Agent, or Firm* — Matthew B. Dernier, Esq.

(57) ABSTRACT

A system for determining prioritisation values for two or more sounds within an audio clip includes: a feature extraction unit operable to extract characteristic features from the two or more sounds, a feature combination unit operable to generate a combined mix comprising extracted features from the two or more sounds, an audio assessment unit operable to identify the contribution of one or more of the features to the combined mix, a feature classification unit operable to assign a saliency score to each of the features in the combined mix, and an audio prioritisation unit operable to determine relative priority values for the two or more sounds in dependence upon the assigned saliency scores for each of one or more features of the sounds.

14 Claims, 4 Drawing Sheets

(51) Int. Cl.
*H04S 3/00* (2006.01)
*H04S 7/00* (2006.01)

(58) Field of Classification Search
CPC . H04S 7/30; H04S 3/008; H04S 7/302; H04S 1/002; H04S 1/00; H04S 2400/11; H04S 2400/13; G10H 1/0008; G10H 1/00; H03G 5/165; H03G 5/16; G06F 16/24578; G10K 11/1752; H04R 2420/01
USPC ..... 704/500–504; 381/17–23, 306, 310, 26, 381/61, 62, 316, 320, 321, 73.1, 74, 80, 381/81, 85, 86, 92, 94.2, 94.3, 94.4, 94.5, 381/94.7, 97–107, 110–115, 118, 119, 381/120, 122, 123; 700/94
See application file for complete search history.

(56) References Cited

U.S. PATENT DOCUMENTS

| | | | | |
|---|---|---|---|---|
| 2015/0073780 | A1* | 3/2015 | Sharma | G10L 25/60 704/205 |
| 2015/0243289 | A1* | 8/2015 | Radhakrishnan | G10L 19/008 704/500 |
| 2018/0115850 | A1* | 4/2018 | De Burgh | H04S 3/008 |
| 2019/0198028 | A1* | 6/2019 | Kim | G10L 19/167 |

OTHER PUBLICATIONS

Combined Search and Examination Report for corresponding GB Application No. GB1911530.2, 5 pages, dated Feb. 12, 2020.

* cited by examiner

SOUND PRIORITISATION SYSTEM AND METHOD

BACKGROUND OF THE INVENTION

Field of the Invention

This disclosure relates to a sound prioritisation system and method.

Description of the Prior Art

The "background" description provided herein is for the purpose of generally presenting the context of the disclosure. Work of the presently named inventors, to the extent it is described in this background section, as well as aspects of the description which may not otherwise qualify as prior art at the time of filing, are neither expressly or impliedly admitted as prior art against the present invention.

As entertainment content, such as video games, becomes increasingly advanced there is often an accompanying increase in the complexity of the content. In some cases, this is reflected in an increase in the graphical or visual quality of the content, while in others this is apparent from an increase in the number of elements (such as characters or objects) present in the content. Similarly, there may also be an increase in the audio complexity of the content—for example, due to the increased number of elements or events that may be simultaneously present in the environment.

An increase in the audio complexity of content may be problematic in that it is only possible to reproduce a finite number of sounds at a given time; therefore in content in which there are a large number of sounds, there may be a number of sounds that are not reproduced. As a result, the viewer may miss out on one or more aspects of the content due to incomplete sound reproduction.

In earlier arrangements, content creators (such as game developers or movie producing teams) define which sounds are important and should therefore have precedence during the reproduction of audio during playback of content for a viewer. During playback of the content, those sounds with a higher precedence ranking may be reproduced in preference to those with a lower precedence ranking, such that only the top N highest ranking sounds are reproduced (where N is the number of sounds that may be simultaneously reproduced).

However such a task may be particularly time consuming, and may not be entirely suitable for the intended purpose—for example, subjectivity may play a role in determining the importance of audio, such that audio is deemed more important to a content creator than it would be by a viewer of the content. Similarly, the context in which the sound appears may be rather important and such complexity may not be reflected in the assigned precedence—for example, a single gunshot may have a very high importance in isolation, but a single gunshot during a scene in which a large number of guns are fired would have a much lower importance.

These drawbacks may result in an audio reproduction that omits important sounds in preference of less-important sounds, or obscures them by generating a number of sounds (which are not considered important) that interfere with a listener's ability to identify individual sounds that are reproduced.

An improvement to audio reproduction systems so as to be able to identify which sounds should be reproduced in preference to other sounds present in the content may therefore considered advantageous.

It is in the context of the above problems that the present invention arises.

SUMMARY OF THE INVENTION

This disclosure is defined by claim 1.

Further respective aspects and features of the disclosure are defined in the appended claims. It is to be understood that both the foregoing general description of the invention and the following detailed description are exemplary, but are not restrictive, of the invention.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DESCRIPTION OF THE EMBODIMENTS

Figure 1:
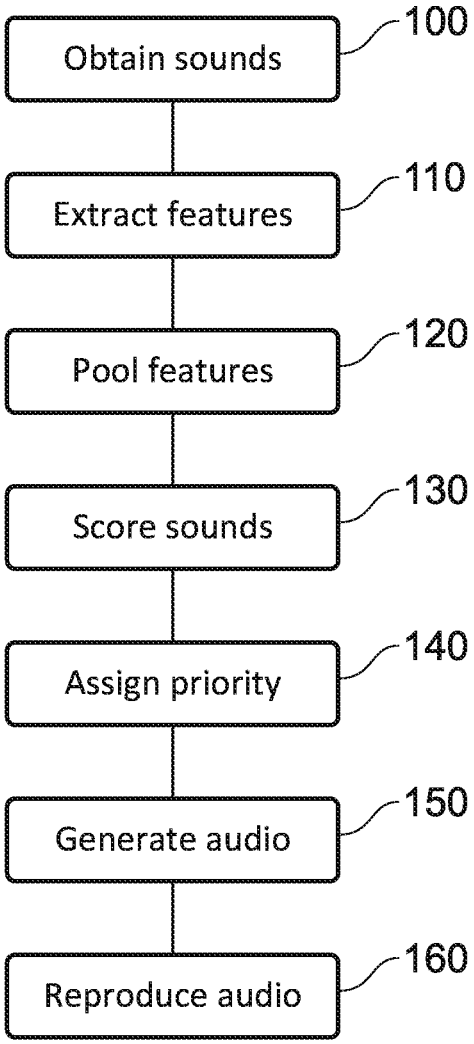
FIG. 1 schematically illustrates an audio reproduction method.

Referring now to the drawings, wherein like reference numerals designate identical or corresponding parts throughout the several views, a number of embodiments of the present disclosure are discussed.

Embodiments of the present disclosure are operable to perform a sound prioritisation method on one or more sounds or sound features that relate to generated or captured audio. Sounds features are considered to be (potentially) perceptually relevant elements of the sounds themselves—for example, the contribution of a sound at a particular frequency (or range of frequencies) may be considered to be a sound feature.

In existing arrangements, sound prioritisation is performed manually (for example, by a game developer or a sound engineer); this may be performed in view of any number of criteria, such as the perceived importance of a sound to the events that are displayed in corresponding video content. For example, a developer may decide that the audio associated with background conversation in a scene should be omitted, or processed to reduce the corresponding number of sounds, in favour of dialogue between main characters in the scene.

Embodiments of the present disclosure may be used to enhance this method, or to replace it entirely. In the first case, the audio that has been selected for output by the developer may form the input to the methods as described in the present disclosure. In the latter case, the audio is provided as an input to the disclosed methods prior to the performing of any manual sound prioritisation method on the audio.

When performing a sound prioritisation method, the perceptual relevance of one or more sounds and/or sound features may be considered. The perceptual relevance of a sound feature may be determined in consideration of a number of different factors, a selection of which are discussed below.

A first factor to consider is that of the relative volume of two or more sounds within the audio; the presence of sounds in the audio may mask the contribution of one or more sounds. It may be considered that the sounds which are masked are of a low perceptual relevance—when provided with the audio, a listener may be unlikely (or even unable) to perceive the masked sounds.

A second factor to consider is that of simultaneous masking. This is masking that occurs when sounds are received simultaneously, and the significance of the masking is dependent upon the respective frequencies of those sounds. For example, two sounds which are closer in frequency may be harder for a listener to distinguish, while two sounds that are of a sufficiently different frequency may be easily distinguished (although of course the listener may not pay attention to each of them). In general, the masking effect applied by a lower-frequency sound is greater than that of a higher-frequency sound of otherwise identical characteristics.

In such cases, the louder of the two sounds will mask the quieter, such that the user may be unable to perceive the quieter sound as being a separate sound to the louder—and therefore cannot identify the second sound at all, if the frequencies overlap entirely. In the case of a partial overlap in frequencies, or simply similar frequencies, the masking that is applied by the louder sound may only be partial and may be dependent upon the relative volumes and/or frequencies of the sounds.

A third example of masking is that of temporal masking; this is masking that occurs due to the presence of a number of sounds in quick succession. For example, a sound may be masked by an immediately preceding or succeeding sound in dependence upon their relative frequencies.

Of course, masking is not the only factor to be considered when evaluating the perceptual relevance of a sound or sound feature. Masking may simply indicate that a user would not be able to hear a sound, or not be able to perceive it with clarity, and as a result the sound would have low perceptual relevance if the audio were presented to the user without modification. However, in some cases perceptually relevant sounds may experience a degree of masking, while less relevant sounds may be completely unmasked. In view of this, other factors should be evaluated.

A first example of such a factor is a consideration of the context in which the sound is provided. For example, when generating audio for an element of a large set of similar elements (such as a single weapon in a battle scene, or a single person in a crowd) it may be considered that each sound is itself of low perceptual relevance even if the user is easily able to distinguish each of the sound sources from the audio. That is, if there were (say) three hundred similar sounds in a short timeframe, it is likely that at least one of those sounds could be omitted without the user noticing—and this may be an indicator of low perceptual relevance.

A second factor that may be considered is that of the location of the sound source that is associated with the sound. For instance, sounds that are far away may be considered to be of lower perceptual relevance to the listener as they are unlikely to be so interested in the sound. This may be particularly true if this distance results in the sound having a lower intensity.

Similarly, sounds associated with sound sources that have a relatively unique location (that is, a location that does not have a high density of sound sources as determined relative to the number of sound sources within the environment) may be considered to have a higher perceptual relevance than that of a sound that originates from a location with a higher density of sound sources. For instance, the sounds associated with each person in a crowd to the left of the listener may be considered of a lower individual perceptual relevance relative to identical sounds associated with a single person to the right of the listener.

It is therefore apparent that the perceptual relevance of a sound may be determined in dependence upon any number of suitable factors; and that the perceptual relevance may be a suitable metric for use in determining which sounds in a mix should be omitted when the number of sounds is too large for correct reproduction.

FIG. 1 schematically illustrates an audio reproduction method based upon sound prioritisation. Of course, steps of this method could be implemented by different processing devices and at substantially different times—for example, the reproduction may not be performed at the time of the prioritisation.

At a step 100, sounds are obtained. For example, these sounds may be associated with a virtual environment, and may be computer generated sounds or sounds that have been captured from real-world sound sources. The sounds may be obtained in any suitable format or structure.

For example, each of the sounds associated with a particular piece of content may be provided. Alternatively, sounds associated with a particular time frame (such as a movie scene or other portion of the content) may be provided—or the sounds may be provided with one or more time stamps identifying when they would be output. Similarly, each of the sounds associated with a sound source may be provided, or the sounds from the same source may be considered independently of one another.

The sounds may be associated with information identifying any other information that may be of use; for example, information identifying where in the virtual scene the sound source is located may be provided, and/or information identifying the sound source/the context in which the sound is provided.

At a step 110, a feature extraction process is performed upon the obtained sounds. This feature extraction process is operable to determine features of each sound that are of perceptual relevance (these may be referred to as perceptual features). In this step, each of the sounds is analysed independently, and as such only features which are inherent to that particular sound are considered; that is, factors such as interference between sounds from different sources are not considered.

At a step 120, the sounds are pooled. This may be performed in any of a number of suitable ways, and effectively comprises an analysis of the overall contributions of the sounds to a mix (that is, the combined audio output from a plurality of sounds) in respect of each of one or more identified perceptual features.

In some embodiments, this may take the form of identifying the perceptually relevant features present in the mix (that is, the perceptually relevant features from each of the sounds) and determining the largest contribution to this feature from amongst the sounds forming the mix. For example, this contribution may be identified based upon the volume of a sound in respect of that feature.

An example of such a pooling includes the generation of a mix having the perceptual feature contributions [2, 2, 4]

(each number representing a contribution corresponding to a different feature, the magnitude of the contribution indicating the audibility of the feature within the sound), the mix being generated from two sounds that have respective contributions of [0, 2, 1] and [2, 0, 4]. The mix is therefore represented by the maximum contribution of each feature from amongst the component sounds; in some cases, it is not necessary to actually generate audio representing the mix, as this information may be suitable for further processing to be performed.

As an alternative, the pooling may simply comprise generating audio representing all of the desired sounds. For example, this may be performed by generating the audio that would be output to a listener for the corresponding content were no prioritisation to be performed.

At a step 130, the features of the pooled sounds are each scored. This step comprises the identification of an individual sound's contribution to the mix. As in step 120, this may be performed in a number of suitable ways; indeed the most suitable manner may be determined in dependence upon how the pooling is performed, in some embodiments.

For instance, when using the feature-wise combination of the first example of step 120 discussed above, the contribution of each sound can be identified from the respective contributions to each feature in the numerical representation.

The scores in step 130 may be assigned to individual features, or to the sounds themselves. In some embodiments, the sound is assigned a score in dependence upon how many of the features are represented in the mix by virtue of having the largest contribution to the mix. For example, with the mix represented by [2, 2, 4], the first sound [0, 2, 1] has a score of one, as the second feature is represented in the mix while the second sound [2, 0, 4] has a score of two, as the first and third features are represented in the mix.

At a step 140, the sounds are assigned a priority value in dependence upon the assigned scores in step 130. For example, sounds with a higher number of features that contribute to a mix may be considered to have a higher priority than those which have a lower number. Similarly, those sounds with a more unique distribution or selection of features for which contributions are provided may also be assigned a higher priority value. Similarly, the location of the sound sources may be considered when determining the priority such that more isolated sound sources may be given a higher precedence.

At a step 150, audio for output is generated. The audio is generated in dependence upon the priority values that have been determined, in combination with at least an identification of the position of the listener within the virtual environment (that is, the relative positions of the listener and the virtual sound sources). In line with the priority values that have been assigned to the sounds, a number of the lower-priority sounds may be omitted from the generated audio. The sounds to be omitted may be determined in any suitable way; for example, a threshold number of sounds to be reproduced may be determined based upon user preference or hardware capability (such as a hardware limit on the number of sounds that can be reproduced).

At a step 160, the audio generated in step 150 is output. The sounds may be output by any suitable audio reproduction apparatus; for example, loudspeakers or headphones may be used, or speakers associated with a display apparatus such as a television or head-mountable display unit.

As discussed above, the feature extraction process is operable to identify one or more features within each of the sounds. These perceptual features may be identified based upon an analysis of the frequencies associated with the sound, the wavelengths of sound, the intensity of different parts (for example, time periods) of the sound, for example. In some cases a more qualitative approach is taken, and sounds may be identified as a particular type (such as 'vehicle noise' or 'speech') and predetermined perceptual features corresponding to that sound type are considered when extracting features.

The identified features for the input sounds may be collated into one or more lists, for example for the whole of the content or for a subset of the content (such as a particular time frame). These lists may be used for evaluating the generated mixes, with scores being assigned for each of the features in a list selected to correspond to a mix. The selected list may be determined in any suitable manner; for example, the smallest list that comprises every feature of each sound in the mix may be selected, or a list that comprises a threshold (or greater) number of features present in the mix. Of course, the score for any feature that is not present in the mix would be '0' for each sound, and so it would not be particularly burdensome to have an excessive number of features in the list.

While presented above as being a simple number, the scores assigned to each of the features in a sound may be more complex in some embodiments. For example, a spatial or temporal dependency may be encoded in the value so as to account for the varying positions of one or more listeners within the environment, and the fluctuations that may be expected in a sound/sound feature over time. While such a feature may increase the amount of processing required to analyse the audio content, it may result in a more robust and transferable output data set.

In some embodiments, the generated audio (from step 150) may be assessed to determine how suitable a representation of the initial mix it is. For example, this may comprise applying the feature extraction process to the generated audio in order to identify which features are present in the audio, and how audible they are. The results of this feature extraction may then be compared to the scores that were assigned to a corresponding pooled representation of the mix used to generate the output audio. Such a comparison may be useful in determining whether features of the sounds used to generate the output audio are well-represented in the output audio. If this is not the case, then modifications may be made to the generation of the audio for output (step 150) in order to improve the representation of one or more features, and/or to reduce the contribution of one or more features to the output audio. The generation of output audio may therefore be an iterative process, in which one or more steps are repeated, rather than necessarily the order shown in FIG. 1.

In some embodiments, this method is implemented using a machine learning based method. While not essential, this may be advantageous in that the perceptually relevant features may be learned rather than predefined, and this may result in an improved scoring and audio generation method. While any suitable machine learning algorithm or artificial neural network may be used to implement embodiments of the present disclosure, examples of particular implementations are discussed below.

In some embodiments, discriminative algorithms may be used to compare generated output audio with a corresponding mix to determine whether or not the generated audio comprises the perceptual features of the mix. In other words, the algorithm may compare the generated audio to the mix to determine whether the two match; if significant perceptual features are only present in one, then this would likely indicate a lack of matching. In this case, the generated audio may be assigned a confidence value that is indicative of the likelihood that the generated audio matches the mix; a threshold may be applied to the confidence values to determine whether the generated audio is sufficiently close to the mix so as to be considered a suitable representation.

While discriminative algorithms may be suitable in some embodiments, in other embodiments a generative learned model (such as a generative adversarial network, GAN) may be used. A GAN may be suitable for such methods as these are processes developed with the aim of generating data that matches a particular target; in the present case, this would equate to generating audio for output that 'matches' (that is, substantially approximates) a mix of the component sounds. A number of alternative methods of utilising a GAN may be employed, two of which are described below.

A first method of utilising a GAN is that of using it to train a conditional generative model. A conditional generative model is a model in which conditions may be applied, such as parameters relating to the desired outputs. In the present case, the conditions may be specified by the features of a desired audio output—that is, conditions relating to the omission of particular features (such as conditions relating to sound source density, contextual importance, or sound/feature repetition). These conditions can be used to guide the generation of the audio for output using the model.

A second method of utilising a GAN is effectively that of 'reverse engineering' feature values for a mix in dependence upon output audio generated from a number of input sounds. Typically, a generative model is provided with one or more input variables (such as a set of sounds/features) from which an output is generated.

A convergent approach may be taken in such an embodiment. The input variables can be modified so as to generate output audio such that the predicted values for a corresponding mix more closely approximate those of the actual mix with an increasing number of iterations. This refinement of the output audio may be defined with a loss function as the objective, as defined between the target mix (that is, the mix corresponding to the sounds for output prior to prioritisation processing) and the successive outputs of the GAN. The input variables are modified iteratively so as to reduce the value of the loss function, indicating a higher degree of similarity between the outputs and the initial mix. Once an output of the GAN is considered to suitably approximate the mix, the output may be used as the audio to be output by the system.

Training of a network may be performed by using a labelled dataset to assist with identifying which features are of higher perceptual relevance than others. For example, a network may be provided with a number of mixes of different sounds along with information identifying the features present in the mix and how easy it is to hear each of those features within the mix. This ease of hearing is indicative of the perceptual relevance of the feature to the mix, as those which are harder to hear are less well-perceived.

The information identifying the perceptual relevance of the features may be used by the network to identify perceptually relevant features from new sounds, by analysing patterns in which features are labelled as being relevant in the initial dataset. The network may then be operable to generate output audio using the labelled dataset, with the predefined information being used to evaluate the correspondence of the generated audio to an existing mix of sounds from the dataset.

Figure 2:
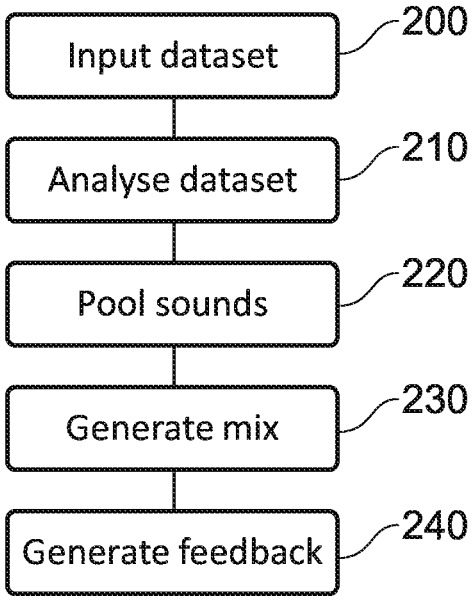
FIG. 2 schematically illustrates a training method.
Figure 3:
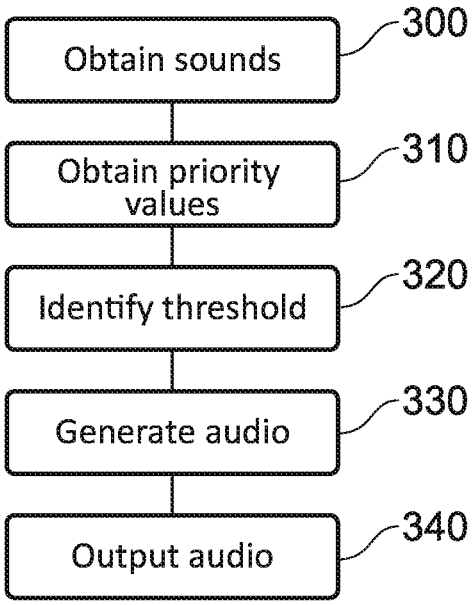
FIG. 3 schematically illustrates an audio reproduction method.

FIGS. 2 and 3 schematically illustrate training and audio reproduction methods respectively; these methods may be implemented in the context of the machine learning embodiments described above.

FIG. 2 schematically illustrates a training method by which a machine learning algorithm or artificial neural network may be trained so as to be able to generate information relating to the prioritisation of sounds or sound features. Of course, any suitable variations upon this training method may be implemented; this Figure represents an example of a single method only.

At a step 200, a labelled dataset is provided as an input to the machine learning algorithm. This may comprise any number of sounds, and information relating to their perceptual relevance. This may further comprise a number of predetermined mixes of those sounds, in addition to information about how those sounds interact with one another within a particular mix.

At a step 210, the dataset is analysed to identify perceptually relevant features within the provided sounds. This may be performed in a number of manners; for example, the identification may be performed independently of the labelling of the dataset with the results being compared to the labels so as to identify whether the features were identified correctly. This step may be performed iteratively, with feedback relating to the successful/unsuccessful feature identifications, so as to improve the feature recognition process.

At a step 220, identified features from the input sounds are pooled so as to generate a representation of a mixture of the sounds. This step may be similar to the process of step 120 of FIG. 1, for example.

At a step 230, a mix is generated from the sounds in dependence upon the information relating to the perceptual relevance of the features as generated in step 210. The mix is then compared to the pooled representation generated in step 220, so as to identify whether the mix presents a substantially similar perceptual impression to a listener. That is to say, the comparison should determine whether the most perceptually relevant features that are present in the pooled representation are also present in the mix.

At a step 240, feedback is generated to assist with improving the mix based upon differences between the mix and pooled features as determined from the comparison in step 230. This feedback may be used to modify the manner in which the mix is generated, so as to generate a mix that is perceptually more similar to the pooled representation. For example, the priority values attributed to one or more sounds, features, or classes of either may be modified in accordance with this feedback.

Once trained, the model may be used to assign scores to newly-obtained sounds indicating their perceptual relevance. For example, a trained model may be supplied with each of the sounds for a game (or a particular scene/passage of play), and saliency scores or prioritisation values may be assigned to each of these sounds. As a part of this process, different combinations of those sounds may be generated and evaluated.

Of course, it is possible that a number of different models may be generated for different use cases. For instance, different content types (such as games and movies) may be associated with different models, and different genres of content (such as action or comedy) may be associated with different models. Models may be provided that are even more specialised than this; for example, a particular title (such as a specific game) may have a corresponding model trained for that title. This may be appropriate in view of the fact that different sounds may have different perceptual relevance in dependence upon the content with which the sound is associated—a gunshot will likely have a lower perceptual relevance in a war game than in a comedy movie, for example.

FIG. 3 schematically illustrates an audio reproduction method that is based upon the use of a set of sounds for which prioritisation values have been determined. Of course, any number of suitable variations on the method described below may be implemented, and the order may be varied as appropriate. For example, as discussed above, variables such as the listener position within an environment may be considered during the audio reproduction method.

At a step 300, the set of sounds to be used for audio reproduction are obtained by the model. These may be the sounds for a particular scene or other time period, for example, or may include sounds corresponding to the entirety of the content.

At a step 310, the priority values corresponding to those sounds are obtained. These may be provided as metadata, for example, or may be encoded into the set of sounds in a suitable manner. For example, a priority value may be provided in the sound file name, or may be indicated by the order in which the sounds are provided to the model.

At a step 320, a threshold priority for sound reproduction is identified. As discussed above, this may be identified in a number of ways—for example, based upon a percentage of the total sounds, a maximum desired number of sounds, or by technical limitations that restrict the number of sounds that may be reproduced.

At a step 330, an audio output is generated in dependence upon the identified threshold. For example, a mix may be generated comprising each of the sounds that meets or exceeds the threshold priority value.

At a step 340, the generated audio from step 330 is output to a listener.

In some embodiments, the priority values (or perceptual relevance measure) of one or more features may be dependent upon a head-related transfer function (HRTF) associated with a listener. A head-related transfer function provides information about the perception of sounds by a listener; for example, it may be possible to identify particularly sensitive frequencies to which the listener may respond, or directions from which the listener is best equipped to hear sounds.

In some embodiments, this dependence upon the HRTF is encoded in the perceptual relevance measure. For example, information indicating the perceptual relevance of a sound for each of a plurality of predetermined HRTFs may be provided and a corresponding set of priority values determined. Upon reproduction, the HRTF of the listener may be compared to the predetermined HRTFs to identify the most similar, and the corresponding priority value may be selected accordingly.

Alternatively, or in addition, the models used to generate the output audio may be provided on a per-user or per-HRTF basis. This can enable a personalised audio output to be generated in dependence upon a particular user's (or group of users') respective perceptual response to audio.

Embodiments of the present disclosure may be of particular use in the context of free viewpoint or other immersive video/interactive content, such as virtual reality content. The value of higher-quality audio and perceptually relevant sound reproduction may be particularly high in such use cases, and due to the movement of the listener within the environment errors or inaccuracies in the audio playback may be generated with a higher frequency. The methods described in this disclosure may provide a more robust and immersive audio experience, improving the quality of these experiences.

Figure 4:
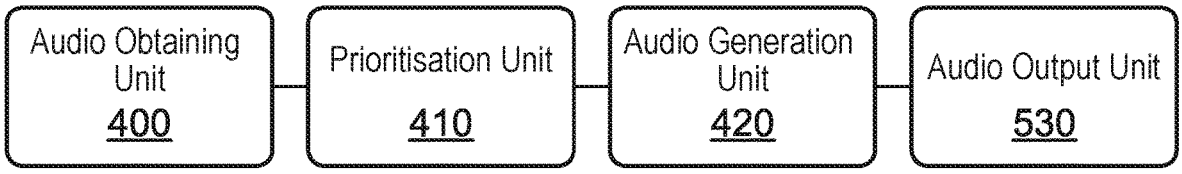
FIG. 4 schematically illustrates a system for reproducing audio content.

FIG. 4 schematically illustrates a system for reproducing output audio. The system comprises an audio obtaining unit 400, a prioritisation unit 410, an audio generation unit 420, and an audio output unit 530. While shown as being connected, it should be considered that the individual units may be distributed amongst a plurality of different processing units as appropriate. For example, the prioritisation may be performed by the prioritisation unit 410 at a first device or server, while the audio generation may be performed by the audio generation unit 420 at another device.

The audio obtaining unit 400 is operable to obtain one or more sets of sounds relating to content; for example, this may comprise sets of sounds that correspond to particular scenes or time periods within the content, different categories of sounds (such as 'vehicle sounds' or 'speech') present within the content, and/or simply a set comprising all of the sounds corresponding to a particular content item. As discussed above, this information may be in any suitable format.

The prioritisation unit 410 is operable to generate prioritisation values for a plurality of the obtained sounds. The functions of this unit are described in more detail below, with reference to FIG. 5.

The audio generation unit 420 is operable to generate an audio output in dependence upon the obtained sounds and their assigned priority values. For example, all sounds with an equal-to or above threshold priority value may be provided in a mix generated by the audio generation unit 420.

The audio output unit 430 is operable to reproduce the audio generated by the audio generation unit 420, or to output it to another device/storage medium for later reproduction of the audio. For example, the audio may be supplied directly to loudspeakers or a content reproduction device such as a television or head-mountable display, may be transmitted through a network to a client device (such as a games console or personal computer) that is operable to initiate playback of the content, and/or may be operable to record the audio to a storage device such as a hard drive or disk.

Figure 5:
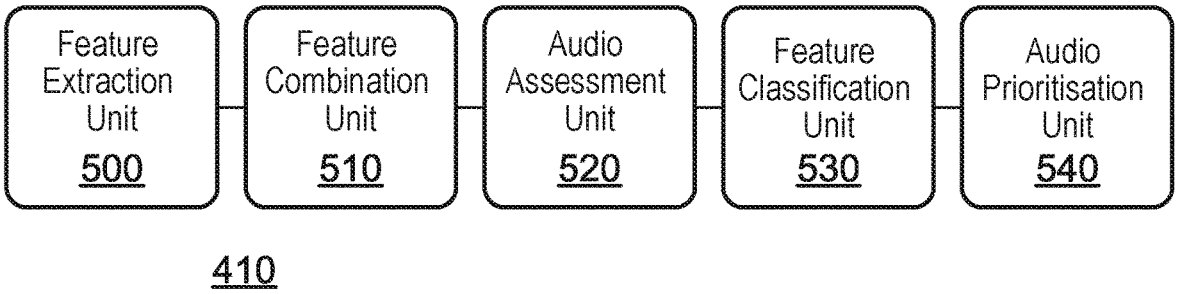
FIG. 5 schematically illustrates a system for determining prioritisation values.

FIG. 5 schematically illustrates the prioritisation unit 410 of FIG. 4; this may be considered to be a system for determining prioritisation values for two or more sounds within an audio clip. The prioritisation unit 410 comprises a feature extraction unit 500, a feature combination unit 510, an audio assessment unit 520, a feature classification unit 530, and an audio prioritisation unit 540. As discussed above, with reference to FIGS. 2 and 3, one or more of these units may be operable to utilise a machine learning model or artificial neural network.

The feature extraction unit 500 is operable to extract characteristic features from the two or more sounds. These characteristic features may comprise one or more audio frequencies, for example, or any other suitable metric by which the feature may be characterised—such as one or more wavelengths of sound.

The feature combination unit 510 is operable to generate a combined mix comprising extracted features from the two or more sounds.

The audio assessment unit 520 is operable to identify the contribution of one or more of the features to the combined mix. This may also comprise identifying one or more characteristics of the audio; for example, the audio assessment unit 520 may be operable to identify the sound source associated with each of one or more of the sounds, or may be operable to identify the location in the environment of one or more of the identified sound sources.

The audio assessment unit 520 may be operable to identify the contribution of the one or more features in dependence upon predicted audio masking; this may be performed in dependence upon an analysis of sounds that occur at similar times within the content, identifying where overlaps in frequencies may impact perception of sounds (or any other factors relating to audio masking, as discussed above).

The feature classification unit 530 is operable to assign a saliency score to each of the features in the combined mix. This saliency score may be a measure of the perceptual relevance of each of the sound features, and may be based upon the ease of perception of the feature within the combined mix. In some embodiments, the feature classification unit 530 is operable to generate a saliency score in dependence upon a head-related transfer function associated with a listener.

In some embodiments, the feature combination unit 510 is operable to generate successive iterations of combined mixes and the audio assessment unit 520 is operable to identify the contribution of one or more features in each of the combined mixes. In such embodiments, the feature classification unit 530 may be operable to assign a saliency score to each feature in dependence upon each of the combined mixes—for example, either a single score that is determined from multiple analyses (that is, an analysis of each combined mix) or a score for each combined mix.

The audio prioritisation unit 540 is operable to determine relative priority values for the two or more sounds in dependence upon the assigned saliency scores for each of one or more features of the sounds.

In some embodiments, the prioritisation unit is provided in combination with an audio mix generating unit (such as the audio mix generating unit 610 of FIG. 6 below). This audio mix generating unit may be operable to generate mixes for output to an audio output device, for example when providing a pre-processed audio stream associated with content.

The prioritisation unit 410 as discussed above may therefore be considered to be an example of a processor that is operable to determine prioritisation values for two or more sounds within an audio clip. In particular, the processor may be operable to:

extract characteristic features from the two or more sounds;

generate a combined mix comprising extracted features from the two or more sounds;

identify the contribution of one or more of the features to the combined mix;

assign a saliency score to each of the features in the combined mix; and determine relative priority values for the two or more sounds in dependence upon the assigned saliency scores for each of one or more features of the sounds.

Figure 6:
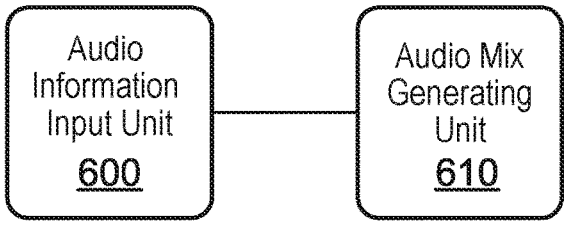
FIG. 6 schematically illustrates a system for generating output audio.

FIG. 6 schematically illustrates a system for generating output audio from input audio comprising two or more sounds. The system comprises an audio information input unit 600 and an audio mix generating unit 610. In some embodiments, this may correspond to the audio generation unit 420 of FIG. 4.

The audio information input unit 600 is operable to receive information identifying priority values for each of the two or more sounds from a system such as that discussed above with reference to FIG. 5.

The audio mix generating unit 610 is operable to generate output audio comprising a subset of the two or more sounds in dependence upon the corresponding relative priority values.

Figure 7:
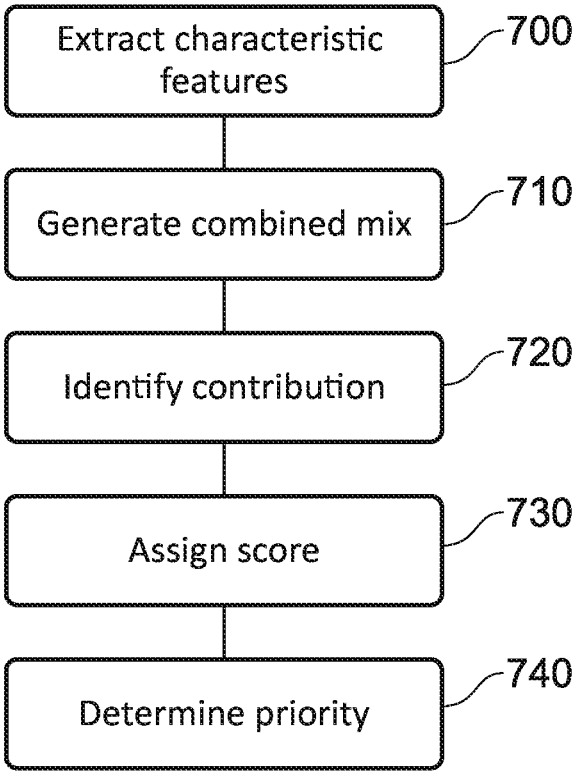
FIG. 7 schematically illustrates a method for determining prioritisation values.

FIG. 7 schematically illustrates a method for determining prioritisation values for two or more sounds within an audio clip.

A step 700 comprises extracting characteristic features from the two or more sounds.

A step 710 comprises generating a combined mix comprising extracted features from the two or more sounds.

A step 720 comprises identifying the contribution of one or more of the features to the combined mix.

A step 730 comprises assigning a saliency score to each of the features in the combined mix.

A step 740 comprises determining relative priority values for the two or more sounds in dependence upon the assigned saliency scores for each of one or more features of the sounds.

Figure 8:
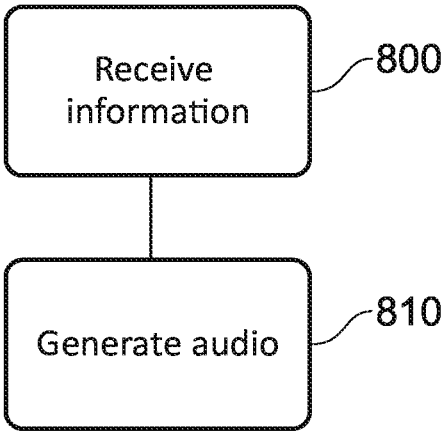
FIG. 8 schematically illustrates a method for generating output audio.

FIG. 8 schematically illustrates a method for generating output audio from input audio comprising two or more sounds.

A step 800 comprises receiving information identifying priority values for each of the two or more sounds, for example information generated in accordance with the method of FIG. 7.

A step 810 comprises generating output audio comprising a subset of the two or more sounds in dependence upon the corresponding relative priority values.

The techniques described above may be implemented in hardware, software or combinations of the two. In the case that a software-controlled data processing apparatus is employed to implement one or more features of the embodiments, it will be appreciated that such software, and a storage or transmission medium such as a non-transitory machine-readable storage medium by which such software is provided, are also considered as embodiments of the disclosure.

Thus, the foregoing discussion discloses and describes merely exemplary embodiments of the present invention. As will be understood by those skilled in the art, the present invention may be embodied in other specific forms without departing from the spirit or essential characteristics thereof. Accordingly, the disclosure of the present invention is intended to be illustrative, but not limiting of the scope of the invention, as well as other claims. The disclosure, including any readily discernible variants of the teachings herein, defines, in part, the scope of the foregoing claim terminology such that no inventive subject matter is dedicated to the public.

The invention claimed is:

1. A system for determining prioritisation values for two or more sounds within an audio clip, the system comprising:

a feature extraction unit operable to extract characteristic features from the two or more sounds;

a feature combination unit operable to generate a combined mix comprising the extracted characteristic feeeures froe ehe ewo or eore sounds;

an audio assessment unit operable to identify a contribution of one or more of the extracted characteristic feeeures eo ehe coebined eix;

a feature classification unit operable to assign a saliency score to each of the extracted characteristic feeeures in ehe coebined eix; end an audio prioritisation unit operable to determine relative priority values for the two or more sounds in dependence upon assigned saliency score for each of the extracted characteristic features of the two or more sounds, wherein the feature classification unit is operable to generate the saliency score in dependence upon a head-related transfer function associated with a listener.

2. The system of claim 1, wherein the characteristic features comprise one or more audio frequencies.

3. The system of claim 1, comprising an audio mix generating unit operable to generate an output audio comprising a subset of the two or more sounds in dependence upon the determined relative priority values.

4. The system of claim 1, wherein the audio assessment unit is operable to identify a respective sound source associated with each of one or more of the two or more sounds.

5. The system of claim 4, wherein the audio assessment unit is operable to identify a location in an environment of the identified respective sound sources.

6. The system of claim 1, wherein one or more of the units is operable to utilise a machine learning model.

7. The system of claim 6, wherein:

the feature combination unit is operable to generate successive iterations of combined mixes; and the audio assessment unit is operable to identify the contribution of one or more features in each of the combined mixes, and the machine learning model is trained using the combined mixes and audio assessments as an input.

8. The system of claim 1, wherein the audio assessment unit is operable to identify the contribution of the one or more features in dependence upon predicted audio masking.

9. The system of claim 1, wherein the saliency score is a measure of the perceptual relevance of each of the extracted characteristic features.

10. A system for generating an output audio from an input audio comprising two or more sounds, the system comprising:

an audio information input unit operable to receive information identifying priority values for each of the two or more sounds by:

(i) a feature extraction unit operable to extract characteristic features from the two or more sounds;

(ii) a feature combination unit operable to generate a combined mix comprising the extracted characteristic from the two or more sounds;

(iii) an audio assessment unit operable to identify a contribution of one or more of the extracted characteristic features to the combined mix;

(iv) a feature classification unit operable to assign a saliency score to each of the extracted characteristic features in the combined mix; and (v) an audio prioritisation unit operable to determine relative priority values for the two or more sounds in dependence upon assigned saliency score for each of the extracted characteristic features of the two or more sounds; and an audio mix generating unit operable to generate output audio comprising a subset of the two or more sounds in dependence upon the determined relative priority values, wherein the feature classification unit is operable to generate the saliency score in dependence upon a head-related transfer function associated with a listener.

11. A method for determining prioritisation values for two or more sounds within an audio clip, the method comprising:

extracting characteristic features from the two or more sounds;

generating a combined mix comprising the extracted characteristic features from the two or more sounds;

identifying a contribution of one or more of the extracted characteristic features to the combined mix;

assigning a saliency score to each of the extracted characteristic features in the combined mix; and determining relative priority values for the two or more sounds in dependence upon assigned saliency score for each of the extracted characteristic features of the two or more sounds, wherein the assigning includes generating the saliency score in dependence upon a head-related transfer function associated with a listener.

12. A method for generating an output audio from an input audio comprising two or more sounds, the method comprising:

receiving information identifying priority values for each of the two or more sounds generated by:

(i) extracting characteristic features from the two or more sounds;

(ii) generating a combined mix comprising the extracted characteristic features from the two or more sounds;

(iii) identifying a contribution of one or more of the extracted characteristic features to the combined mix;

(iv) assigning a saliency score to each of the extracted characteristic features in the combined mix; and (v) determining relative priority values for the two or more sounds in dependence upon assigned saliency score for each of the extracted characteristic features of the two or more sounds; and generating an output audio comprising a subset of the two or more sounds in dependence upon the determined relative priority values, wherein the assigning includes generating the saliency score in dependence upon a head-related transfer function associated with a listener.

13. A non-transitory machine-readable storage medium which stores computer software which, when executed by a computer, causes the computer to perform a method for determining prioritisation values for two or more sounds within an audio clip, the method comprising:

extracting characteristic features from the two or more sounds;

generating a combined mix comprising the extracted characteristic features from the two or more sounds;

identifying a contribution of one or more of the extracted characteristic features to the combined mix;

assigning a saliency score to each of the extracted characteristic features in the combined mix; and determining relative priority values for the two or more sounds in dependence upon assigned saliency score for each of the extracted characteristic features of the two or more sounds, wherein the assigning includes generating the saliency score in dependence upon a head-related transfer function associated with a listener.

14. A non-transitory machine-readable storage medium which stores computer software which, when executed by a computer, causes the computer to perform a method for generating an output audio from an input audio comprising two or more sounds, the method comprising:

receiving information identifying priority values for each of the two or more sounds generated by:

(i) extracting characteristic features from the two or more sounds;

(ii) generating a combined mix comprising the extracted characteristic features from the two or more sounds;

(iii) identifying a contribution of one or more of the extracted characteristic features to the combined mix;

(iv) assigning a saliency score to each of the extracted characteristic features in the combined mix; and (v) determining relative priority values for the two or more sounds in dependence upon assigned saliency score for each of the extracted characteristic features of the two or more sounds; and generating an output audio comprising a subset of the two or more sounds in dependence upon the determined relative priority values, wherein the assigning includes generating the saliency score in dependence upon a head-related transfer function associated with a listener.

* * * * *